US005918777A

United States Patent [19]

Flak

[11] Patent Number: 5,918,777

[45] Date of Patent: Jul. 6, 1999

[54] DISPENSING PACKAGE FOR VISCOUS LIQUID PRODUCT

[75] Inventor: Frank Flak, Ada, Ohio

[73] Assignee: Owens-Brockway Plastic Products Inc., Toledo, Ohio

[21] Appl. No.: 08/604,588

[22] Filed: Feb. 21, 1996

[51] Int. Cl.[6] ..... B65D 37/00

[52] U.S. Cl. ..... 222/212

[58] Field of Search ..... 222/212, 556, 222/334, 494

[56] References Cited

U.S. PATENT DOCUMENTS

| | | | |
|---|---|---|---|
| Re. 30,861 | 2/1982 | Krawagna . | |
| D. 204,511 | 4/1966 | Leeds et al. . | |
| D. 223,602 | 5/1972 | Hoffman . | |
| D. 224,092 | 7/1972 | Steidley . | |
| D. 236,880 | 9/1975 | Sway . | |
| D. 245,225 | 8/1977 | Lyons . | |
| D. 325,164 | 4/1992 | Cann et al. . | |
| D. 353,332 | 12/1994 | Behm et al. . | |
| 1,033,688 | 7/1912 | Fuchs . | |
| 1,033,689 | 7/1912 | Fuchs . | |
| 1,102,302 | 7/1914 | Slade . | |
| 1,173,546 | 2/1916 | Baron . | |
| 1,666,743 | 4/1928 | Klopsteg . | |
| 1,861,602 | 6/1932 | Koze . | |
| 1,925,926 | 9/1933 | Kunkel | 222/494 |
| 2,272,867 | 2/1942 | Cobel . | |
| 2,312,380 | 3/1943 | Bernhardt . | |
| 2,361,958 | 11/1944 | Nyden . | |
| 2,391,345 | 12/1945 | Punte . | |
| 2,474,678 | 6/1949 | Kitchen . | |
| 2,484,148 | 10/1949 | Beatty et al. . | |
| 2,574,422 | 11/1951 | Stoos, Jr. et al. . | |
| 2,575,106 | 11/1951 | Hermani . | |
| 2,694,511 | 11/1954 | Bogeaus et al. . | |
| 2,808,183 | 10/1957 | Olson et al. . | |
| 2,812,120 | 11/1957 | Beall, Jr. . | |
| 2,894,660 | 7/1959 | Gordon . | |
| 3,078,497 | 2/1963 | Micallef . | |
| 3,094,256 | 6/1963 | Ensch . | |
| 3,131,824 | 5/1964 | Van Baarn . | |
| 3,135,441 | 6/1964 | Wise et al. . | |

(List continued on next page.)

FOREIGN PATENT DOCUMENTS

| | | |
|---|---|---|
| 0591601 | 4/1994 | European Pat. Off. . |
| 3217180 | 7/1975 | France . |
| 8618500 | 12/1986 | France . |
| 2120079 | 11/1972 | Germany . |
| 8815614 | 2/1989 | Germany . |
| 4771 | 12/1976 | United Kingdom . |

OTHER PUBLICATIONS

Photographs labeleed "A" through "G", each showing three closure specimens.

Seaquist Closures Publications (2 sides) C–044/5M entitled "Disc Top Dispensing Closures", 1986.

*Primary Examiner*—Philippe Derakshani

[57] ABSTRACT

A dispensing package including a plastic container having a surface recessed in portion of the container and an opening in the recessed portion of the container and a valve system in overlying position to the opening and including a valve member movable manually from a closed position to an open dispensing position is disclosed. The container has a flexible portion which can be squeezed for dispensing the product through the opening. In one form, the valve system comprises a fitment and a toggle valve pivoted on the fitment. The toggle valve includes a discharge passage which is closed and opened so that the product can be dispensed by squeezing the container. In another form, the toggle valve is pivoted directly in the recess on the plastic container. In another form, the valve system consists of a fitment having an opening and a valve member hinged to the fitment. In another form, the valve system comprises a valve member which engages a complementary surface on the opening of the container and is movable by a toggle action. The recess may extend partially across the upper surface of the container or completely across the upper surface of the container. In some forms, the plastic container has a modified upper surface to minimize accumulation of liquid product adjacent the outlet of the container.

38 Claims, 7 Drawing Sheets

U.S. PATENT DOCUMENTS 3,157,322 11/1964 Bernhardt .
3,201,011 8/1965 Brocken .
3,252,632 5/1966 Hagenes .
3,300,104 1/1967 Burt .
3,302,835 2/1967 Eckles .
3,303,971 2/1967 Stevens, Jr. .
3,371,827 3/1968 Micallef .
3,377,005 4/1968 Marder .
3,383,019 5/1968 Waterman .
3,400,866 9/1968 Fattori .
3,429,488 2/1969 Micallef .
3,471,066 10/1969 Micallef .
3,484,027 12/1969 Micallef .
3,516,581 6/1970 Micallef .
3,539,075 11/1970 Bautista .
3,542,256 11/1970 Waterman .
3,642,179 2/1972 Micallef .
3,653,546 4/1972 Hazzard .
3,675,804 7/1972 Micalief .
3,675,812 7/1972 Foster .
3,702,165 11/1972 Carow et al. .
3,734,359 5/1973 Waterman .
3,771,685 11/1973 Micallef .
3,785,528 1/1974 Mandeltort .
3,847,313 11/1974 Micallef .
3,853,250 12/1974 Alpern .
3,948,422 4/1976 Micallef .
3,957,181 5/1976 Hazzard .
3,967,764 7/1976 Hazzard .
4,006,836 2/1977 Micallef .
4,015,756 4/1977 Beck .
4,022,352 5/1977 Pehr .
4,158,902 6/1979 Chernack et al. .
4,219,138 8/1980 Hazard .
4,220,248 9/1980 Wilson et al. .
4,291,818 9/1981 Nozawa et al. .
4,343,397 8/1982 Nozawa et al. .
4,358,032 11/1982 Libit .
4,371,095 2/1983 Montgomery et al. .
4,377,247 3/1983 Hazard et al. .
4,399,928 8/1983 Klingler .
4,441,637 4/1984 Libit .
4,487,342 12/1984 Shy .
4,579,260 4/1986 Young et al. .
4,598,839 7/1986 Dombroski et al. .
4,625,898 12/1986 Hazard .
4,645,086 2/1987 Rosenthal .
4,678,107 7/1987 Ennis, III .
4,732,303 3/1988 Wang .
4,776,501 10/1988 Ostrowsky .
4,793,502 12/1988 Beck .
4,815,616 3/1989 Silvenis .
4,838,460 6/1989 Moore et al. .
4,848,601 7/1989 Reil .
4,861,541 8/1989 Kaminski et al. .
4,911,635 3/1990 Kaminski et al. .
4,962,869 10/1990 Gross et al. .
4,978,035 12/1990 Morane et al. .
4,982,882 1/1991 Gueret .
5,022,566 6/1991 Song et al. .
5,022,567 6/1991 Frazer .
5,052,595 10/1991 Mon .
5,054,662 10/1991 Santagiuliana .
5,058,775 10/1991 Gross et al. .
5,065,912 11/1991 Rosenthal .
5,105,989 4/1992 Gutkowski ..... 222/212
5,123,561 6/1992 Gross .
5,147,072 9/1992 Dirksing .
5,192,005 3/1993 Zimmerman .
5,201,440 4/1993 Gross ..... 222/556
5,213,235 5/1993 Miranda .
5,236,107 8/1993 Spaanstra, Sr. .
5,242,079 9/1993 Stephens et al. .
5,259,538 11/1993 Tardif .
5,279,451 1/1994 Mueller et al. .
5,284,264 2/1994 Gross .
5,314,093 5/1994 Gross et al. .
5,341,960 8/1994 Lay .
5,346,100 9/1994 Lay .
5,370,277 12/1994 Wallis .
5,370,284 12/1994 Dirksing .
5,482,172 1/1996 Braddock .
5,544,790 8/1996 Lu ..... 222/212

DISPENSING PACKAGE FOR VISCOUS LIQUID PRODUCT

This invention relates to dispensing packages for liquid product and particularly to a dispensing package comprising a novel flexible plastic container and a novel valve assembly for dispensing liquid product from the plastic container.

BACKGROUND AND SUMMARY OF THE INVENTION

In the dispensing of viscous products from flexible plastic containers it is common to use a threaded closure with a valve therein which is manually operable to open and close the opening of the finish on which the closure is threaded. The closure includes an inner skirt on which the threads are formed for engagement with the threads on the finish and an outer skirt having the configuration of the container. A valving arrangement is provided in the closure. In one type of closure for a threaded container, a toggle valve arrangement is provided as shown, for example, in U.S. Pat. No. 3,516,581 wherein a toggle valve is pivoted between a closed position cutting off flow from the container and an open position providing communication to the exterior of the closure.

In another type of closure that is used with a threaded container, a valve arrangement includes a valve which has a concave surface on the threaded portion of the closure which is engaged by a convex surface on a portion that is pivoted thereon between open and closed positions as shown, for example, in U.S. Pat. No. 3,702,165.

In still another form of arrangement used in condiment packages, a portion of the closure is pivoted to permit flow of condiment out of a number of openings as shown, for example, in U.S. Pat. Nos. 1,033,688, 1,033,689, 2,361,958, 3,303,971, 3,383,019 and 5,192,005. In another type of package as shown in U.S. Pat. No. 5,213,325, a plastic top is provided with a monoblock body with a substantially T-shaped recess portion on to which a cap is positioned with one portion of the cap releasably attached and another portion is T-shaped to close a non-centralized circular spout on the container. Such dispensing packages have various disadvantages which in some instances include the cost of manufacturing and the cost of materials.

Among the objectives of the present invention are to provide a dispensing package wherein the plastic container is modified to receive a valve system that requires less plastic material; which permits increasing the number of cavities in a mold; which is easier to mold; which cost is lower in cost; wherein functionality of the valve system is maintained; and which lessens the waste space permitting more product to be provided in the volume of the package and reduces the space of the package facilitating storage cost and utilization of shelf space.

In accordance with the invention, the dispensing package comprises a plastic container having a surface recessed in portion of the container and an opening in the recessed portion of the container. The container has a flexible portion which can be squeezed for dispensing the product through the opening. A valve system is snapped in overlying position to the opening and includes a valve member movable manually from a closed position to an open dispensing position. In one form, the valve system comprises a fitment snapped into position and a toggle valve pivoted on the fitment. The toggle valve includes an opening which in one position is closed and in another position is open to provide communication with the opening in the container so that the product can be dispensed by squeezing the container. The toggle valve has a discharge passage through which the liquid product flows to the exterior of the toggle valve. In another form, the toggle valve is pivoted directly in the recess on the plastic container. In another form, the valve system consists of a fitment having an opening and a valve member hinged to the fitment and movable into position opening and closing the opening in the fitment. In another form, the valve system comprises a valve member which engages a complementary surface on the opening of the container and is movable between closed position and open position.

The recess on a portion of the plastic container is preferably on the upper surface of the container and extends transversely or the upper surface. The recess may extend partially across the upper surface of the container or completely across the upper surface of the container. In some forms, the plastic container has a modified upper surface to minimize accumulation of liquid product adjacent the outlet opening of the container.

Figure 18A:
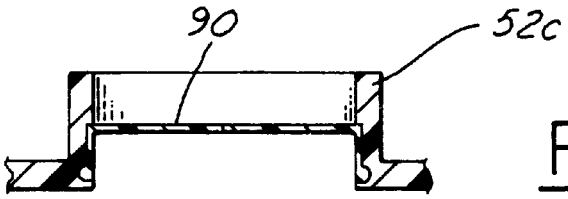
FIG. 18A is a fragmentary sectional view taken substantially along the line 18A—18A in FIG. 17.

18B is a view similar to that of FIG. 18A showing the slit diaphragm value in the open position.

DESCRIPTION OF THE PREFERRED EMBODIMENTS

Referring to FIGS. 1–6, the dispensing package 20 embodying the invention comprises a hollow plastic container 22 and a valve assembly 24. The container 22 has opposed flexible walls 26 and is herein shown as being generally oval in cross section which has a long axis and a short axis. The container 22 further includes an inwardly extending recess 28 that extends transversely between the walls 26 and defines top wall portions 30. Recess 28 includes a base wall 29 and side walls 31 extending upwardly from base wall 29. Valve assembly 24 is positioned in the recess 28 and in the closed position has a top wall which is in the same plane as the top wall portions 30. The container 22 includes a finish 32 defining an opening 33 in the bottom wall 29 of the recess 28 which has an annular bead 34 thereon.

Figure 1:
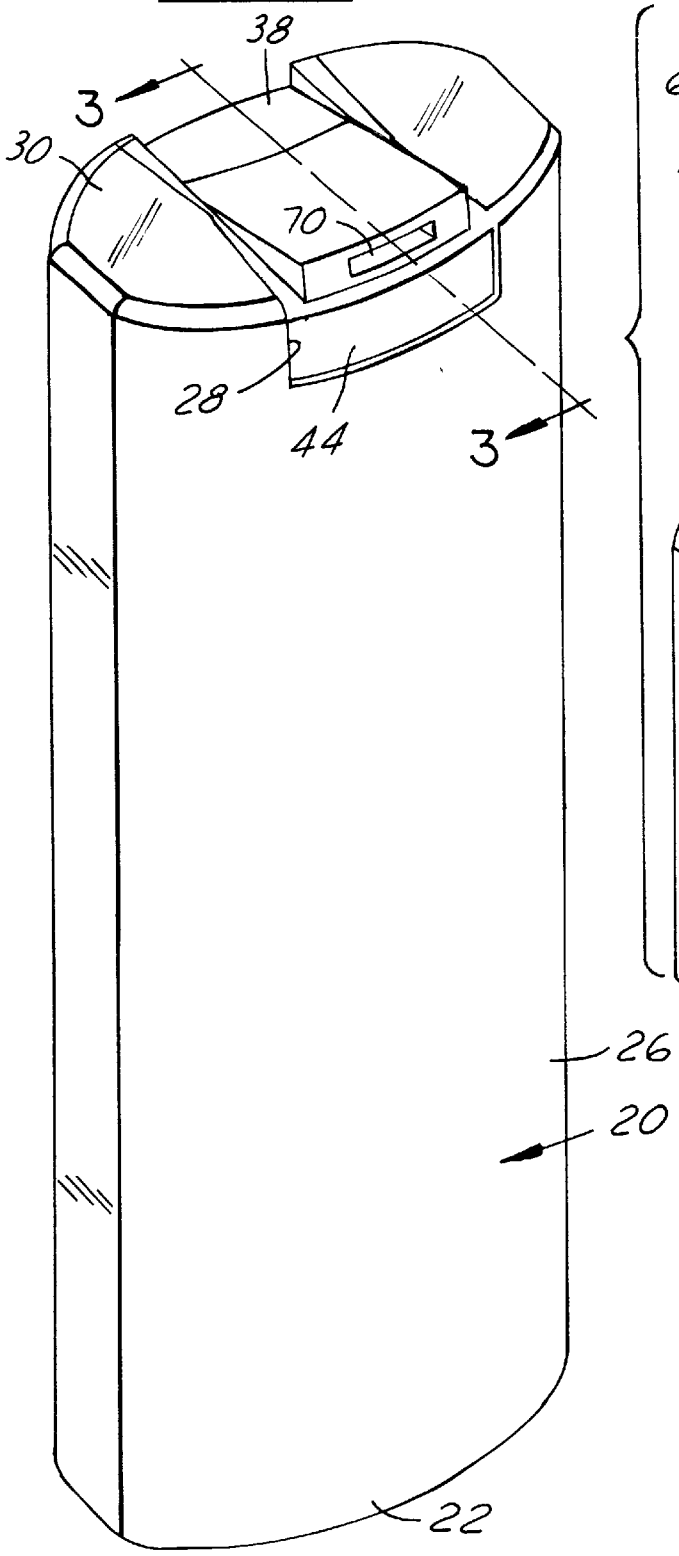
FIG. 1 is a perspective view of the dispensing package embodying the invention.
Figure 2:
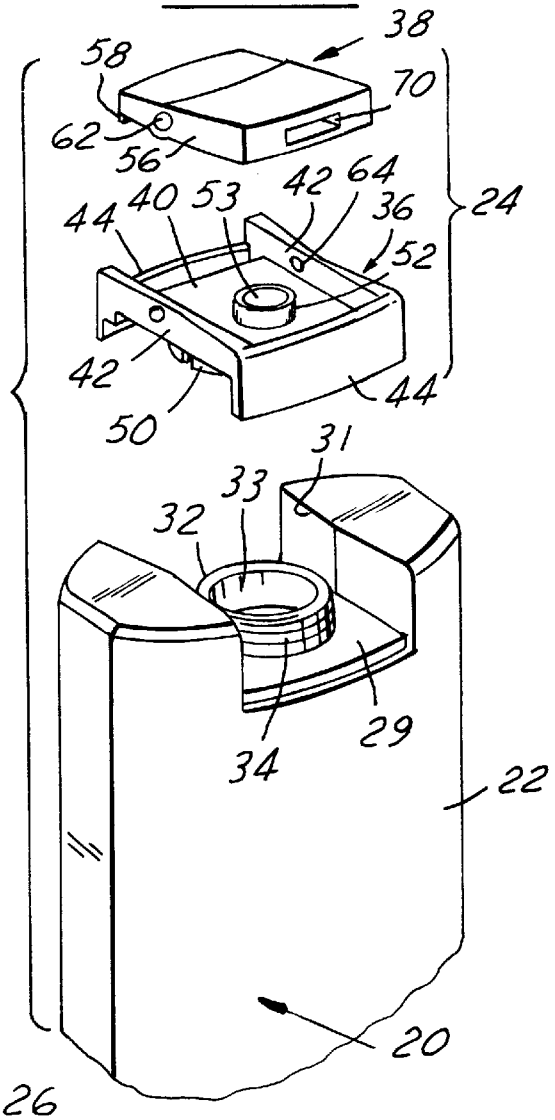
FIG. 2 is a fragmentary exploded view of the dispensing package.
Figure 3:
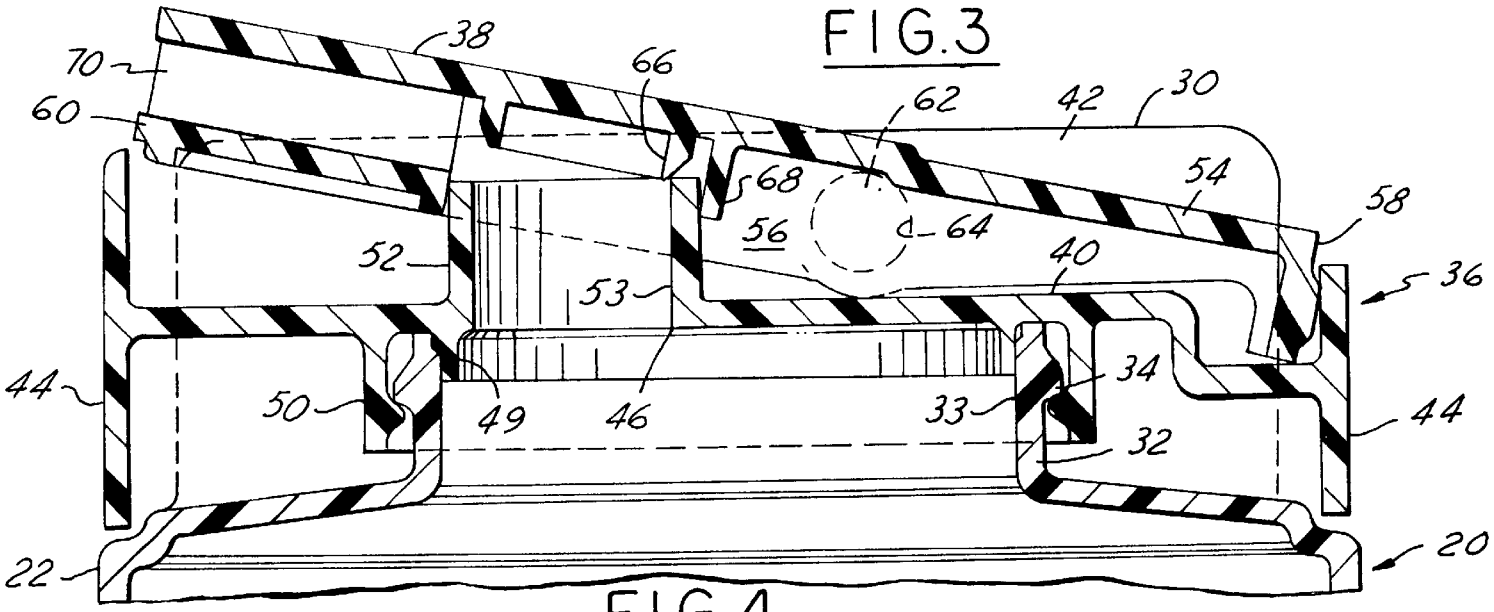
FIG. 3 is a fragmentary sectional view taken along the line 3—3 in FIG. 1 showing the open dispensing position.
Figure 4:
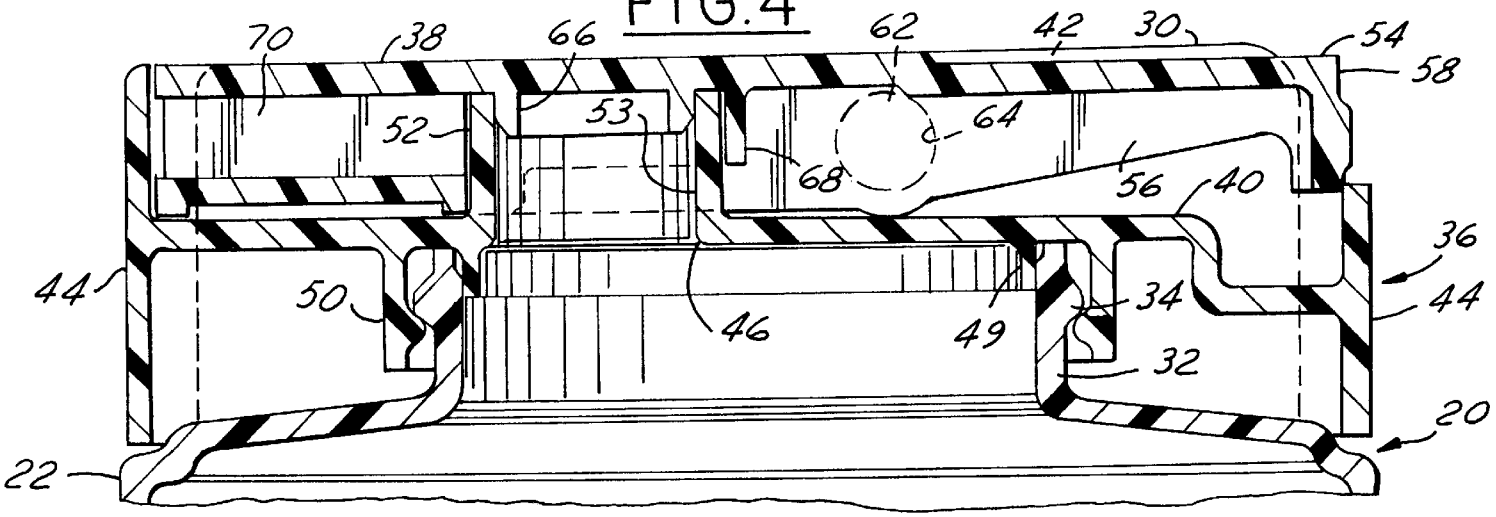
FIG. 4 is a view similar to FIG. 3 showing the closed position.
Figure 5:
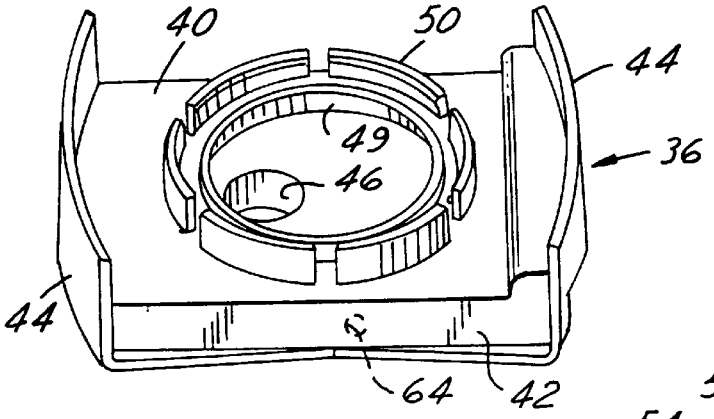
FIG. 5 is a bottom perspective view of a fitment forming a part of the package.
Figure 6:
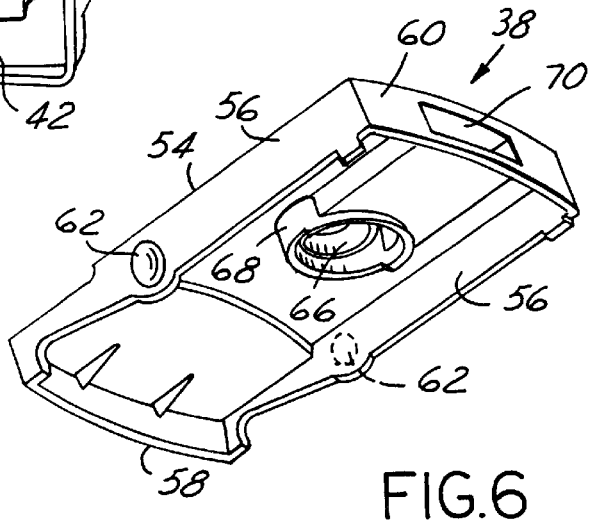
FIG. 6 is a bottom perspective view of the valve forming part of the package.

Valve assembly 24 comprises a plastic fitment 36 and a plastic valve member 38. Fitment 36 comprises a transverse wall 40 extending between side walls 42 and end walls 44. Transverse wall 40 has an opening 46 therethrough which overlies a portion of the opening 33 of the finish 32 of the container 22 and is smaller than the opening in the finish 32. The underside of transverse wall 40 is formed with an annular plug seal 49 and an interrupted annular bead 50 which cooperates with the finish 32 as shown in FIGS. 3 and 4. Transverse wall 40 also includes an upwardly extending integral cylindrical wall 52.

The container fitment and valve member are made of plastic material such as polypropylene, polyethylene, PVC or PET or other organic polymers or copolymers.

Valve member 36 comprises a generally flat top wall 54, downwardly extending side walls 56 and end walls 58, 60. Side walls 56 are provided with outwardly extending bosses 62 which snap into openings or depressions 64 in the inside surface of side walls 42 of the fitment to provide limited pivoting or toggle action of the valve member 38 relative to the fitment 36. Valve member 38 is further provided with an annular plug seal 66 and partial annular seal 68 on its underside that cooperates with cylindrical portion 52 of the fitment 36 in a manner substantially similar to U.S. Pat. No. 3,516,581 incorporated herein by reference. Valve member 38 also includes a dispensing passage 70 which extends from the area of the cylindrical wall 52 to the end wall 60. When the valve member is in open position as shown in FIG. 3 and the flexible walls 26 of the container are squeezed, the liquid contents pass through the opening 33 in the finish 32 and thereafter through the opening 53 defined by the cylindrical wall 52 to the passage 70 and outwardly to the exterior. In this position the wall 68 directs the contents toward the passage 70. When the valve member 38 is in closed position as shown in FIG. 4, the opening 53 of the cylindrical wall 52 is sealed.

Figure 7:
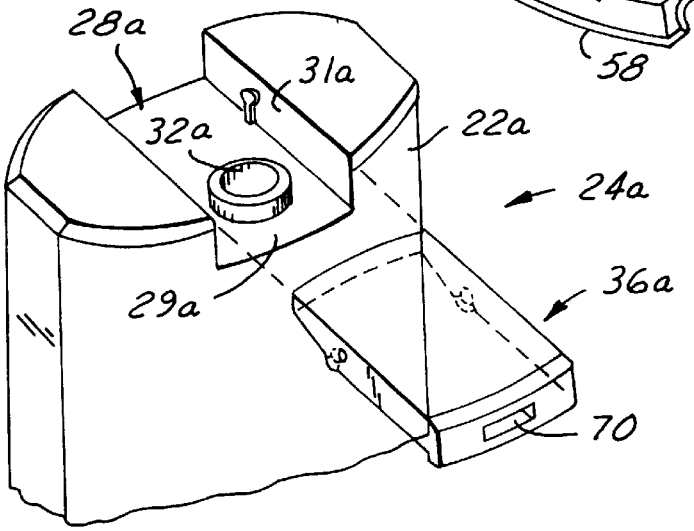
FIG. 7 is a fragmentary exploded perspective view of a modified form of package.

Referring to FIG. 7, in this modified form of dispensing package, the valve assembly 24*a* consists of the valve member 36*a* which is mounted directly on the side walls 31*a* of recess 28*a* of the container 22*a* and cooperates and seals against an upwardly extending cylindrical wall 32*a* in the base of the recess 28*a*. The underside of valve member 36*a* is identical to that in FIG. 6.

Figure 8:
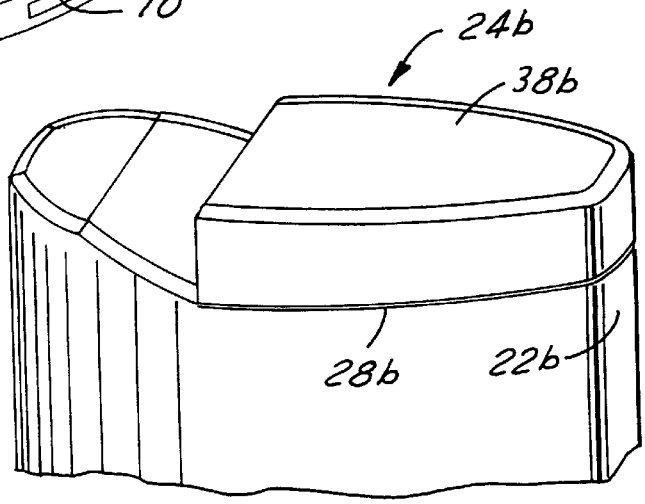
FIG. 8 is a fragmentary perspective view of another modified form of package.

Referring to FIG. 8, in this modified form of dispensing package, the valve assembly 24*b* is substantially identical to that shown in FIGS. 1–6 except that it is positioned in a recess 28*b* extending along the long axis of the container 22*b* and extends from one end of the oval configuration and terminates before reaching the other end. Valve member 38*b* is pivoted to the fitment (not shown) about an axis parallel to the axis of the top of the container and is depressed on the left as viewed in FIG. 8 to open the discharge passage (not shown) so that the product can be dispensed.

Figure 9:
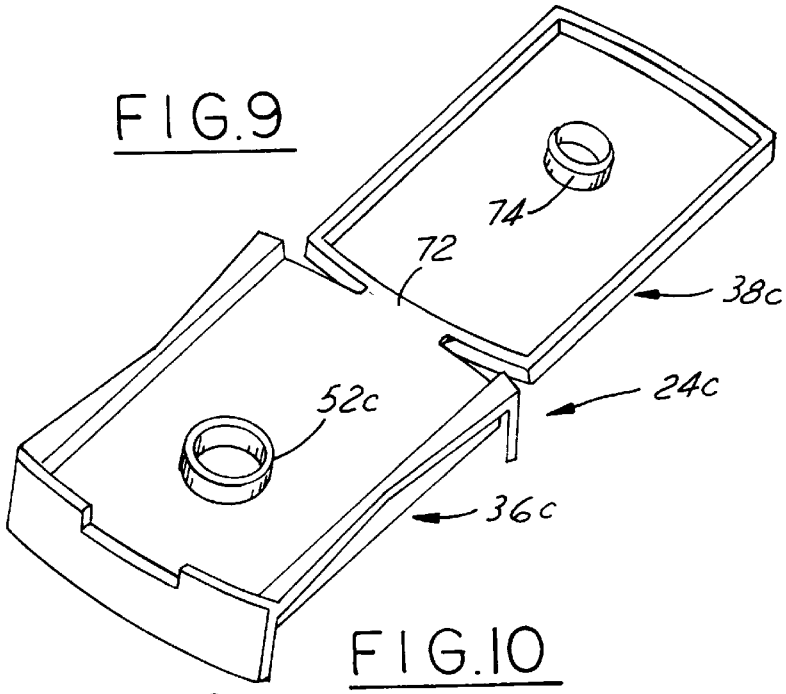
FIG. 9 Is a perspective view of a modified form of valve assembly.
Figure 10:
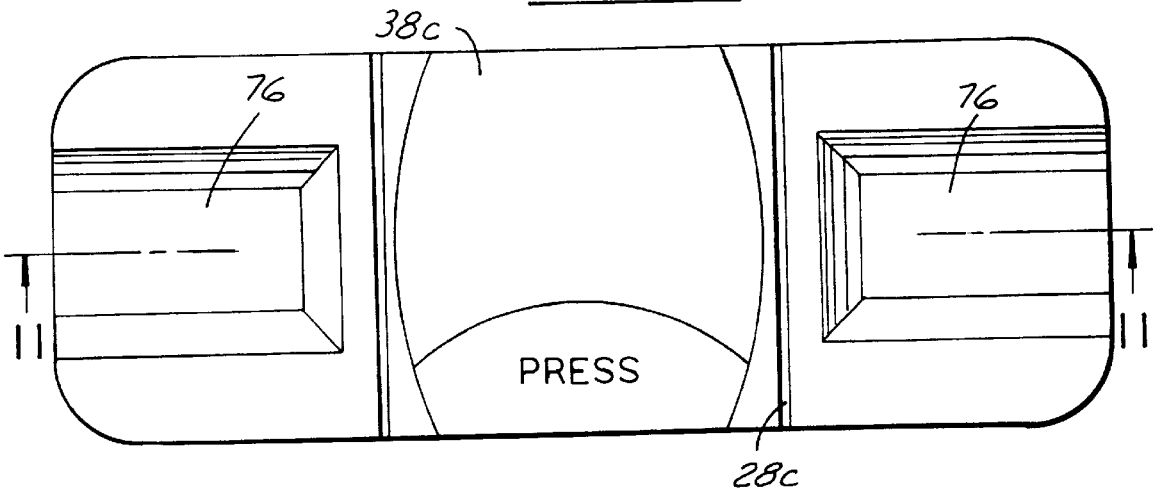
FIG. 10 is a top view showing the valve assembly of FIG. 9 in position on a container.
Figure 11:
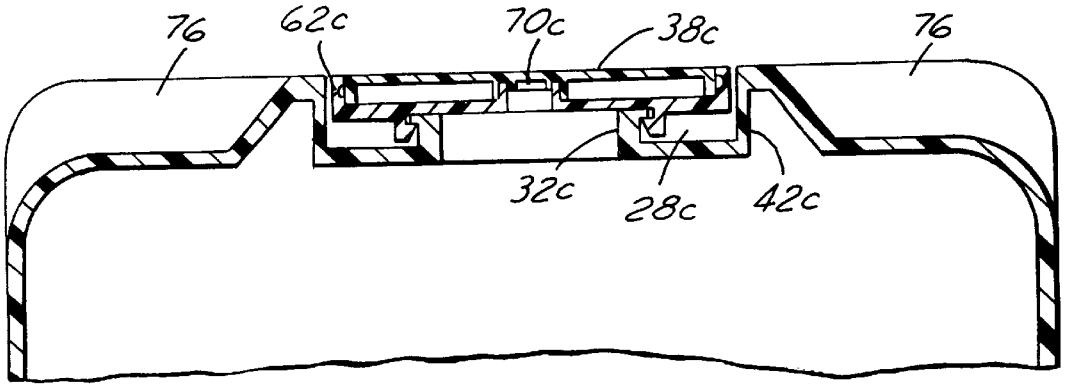
FIG. 11 is a sectional view taken along the line 11—11 in FIG. 10.
Figure 17:
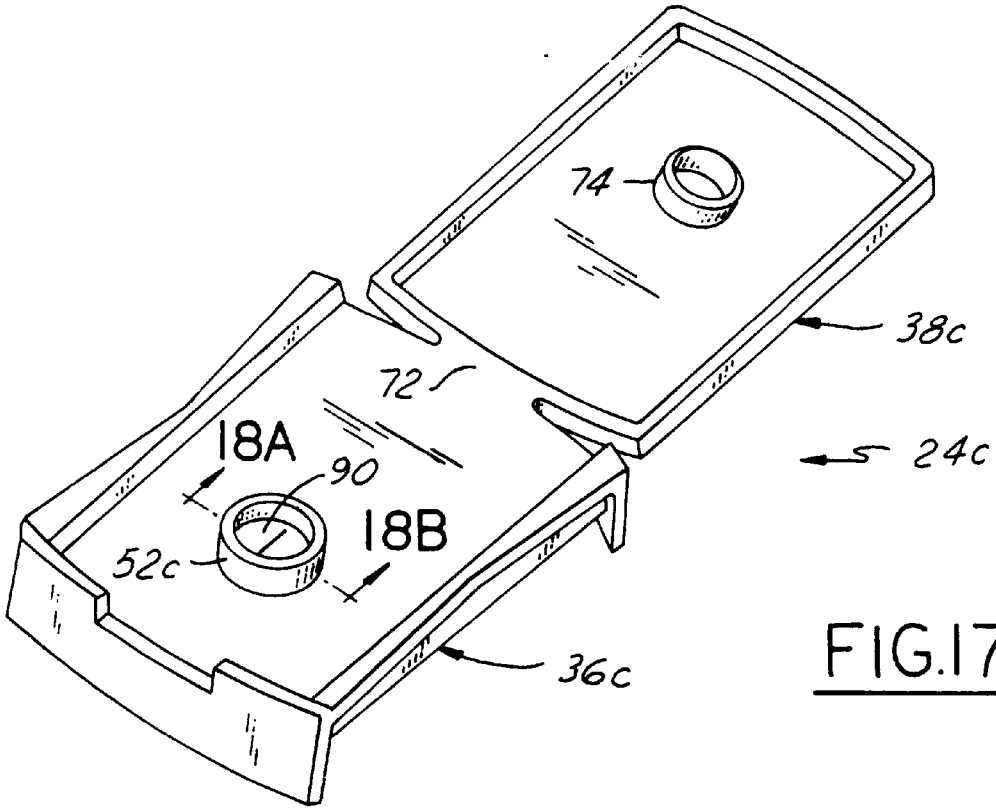
FIG. 17 is a perspective view of a further modified form of the value assembly.
Figure 18B:
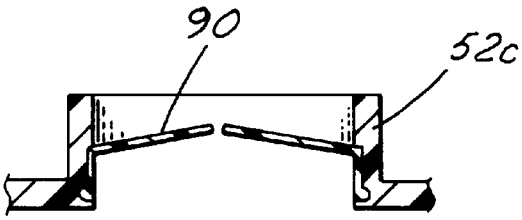

In the modified form of package shown in FIGS. 9–11, the valve assembly 24*c* comprises a fitment 36*c* which is substantially identical to fitment 36. A valve member 38*c* is connected by an integral hinge 72 to the fitment 36*c* and has a plug seal 74 on the underside thereof engaging the opening 52*c* defined by the cylindrical wall 52*c* on the fitment 36*c*. In this form, the recess 28*c* extends transversely of the container which is generally rectangular in cross section and has a long axis and a short axis. A slit diaphragm valve 90 (FIG. 17–18B) of resilient elastomeric material may be mounted on or inserted in opening 52*c* such that when the container is squeezed, the liquid product will be dispensed. In such an arrangement, valve member 38*c* would function as an overcap to prevent dispensing during normal handling and transporting and the plug seal may not be necessary. Such slitted fitments are shown in U.S. Pat. Nos. 1,206,661, 1,242,654, 1,825,553, 2,175,052.

In addition, as shown in FIGS. 9 and 10, the container has inwardly extending recesses 76 which extend inwardly to the depth of the base wall 29*c*. This reduces the space above the base wall and minimizes accumulation of viscous product at the corners of the container.

Figure 12:
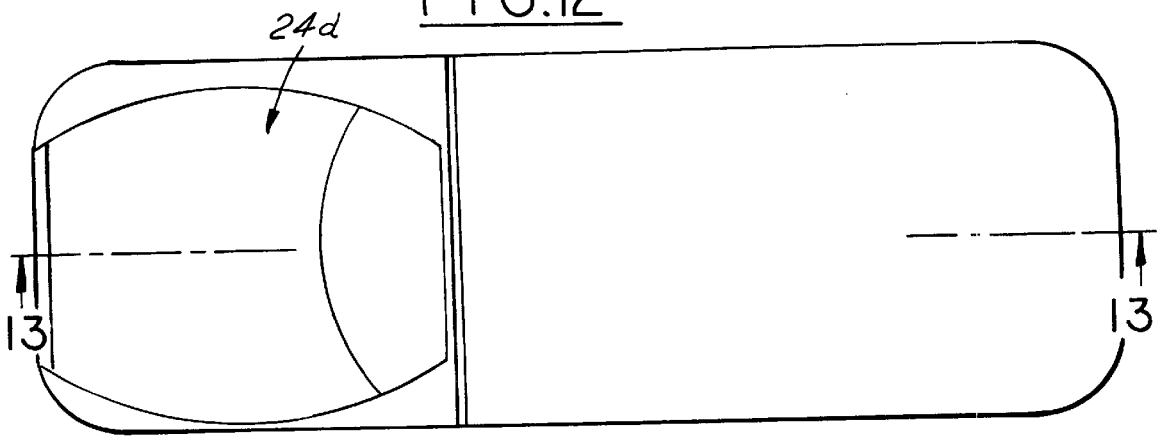
FIG. 12 is a top plan view of a modified dispensing package.
Figure 13:
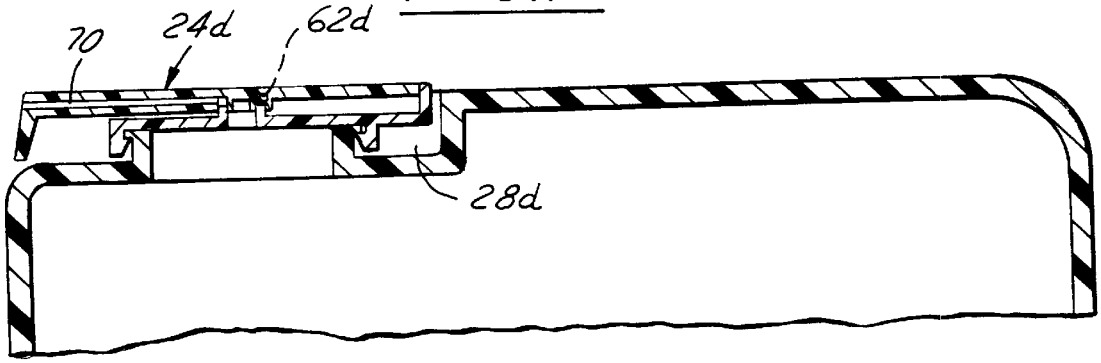
FIG. 13 is a fragmentary vertical sectional view taken along the line 13—13 in FIG. 12.

In the modified form of package shown in FIGS. 12 and 13, the valve assembly 24*d* is provided in a recess 29*d* that extends along the axis of a container having a rectangular cross section for only a portion of the long axis. Otherwise, the assembly 24*d* is like that shown in FIGS. 1–6.

Figure 14:
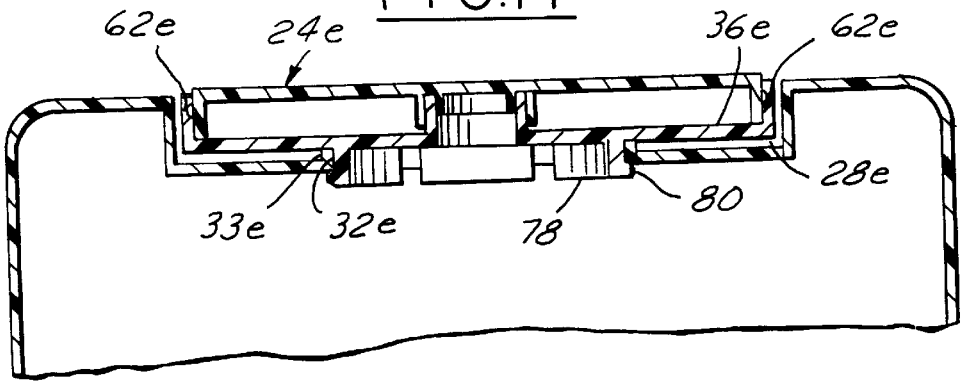
FIG. 14 is a fragmentary vertical sectional of a further modified form of package.

In a modified form of package shown in FIG. 14, valve assembly 24*e* is such that a segmented annular portion 78 extends downwardly from the fitment 36*e* through the opening 33*e* in the finish 32*e*. Each segment 78 includes a bead 80 that snaps below the finish to hold the fitment 36*e* in position.

Figure 15:
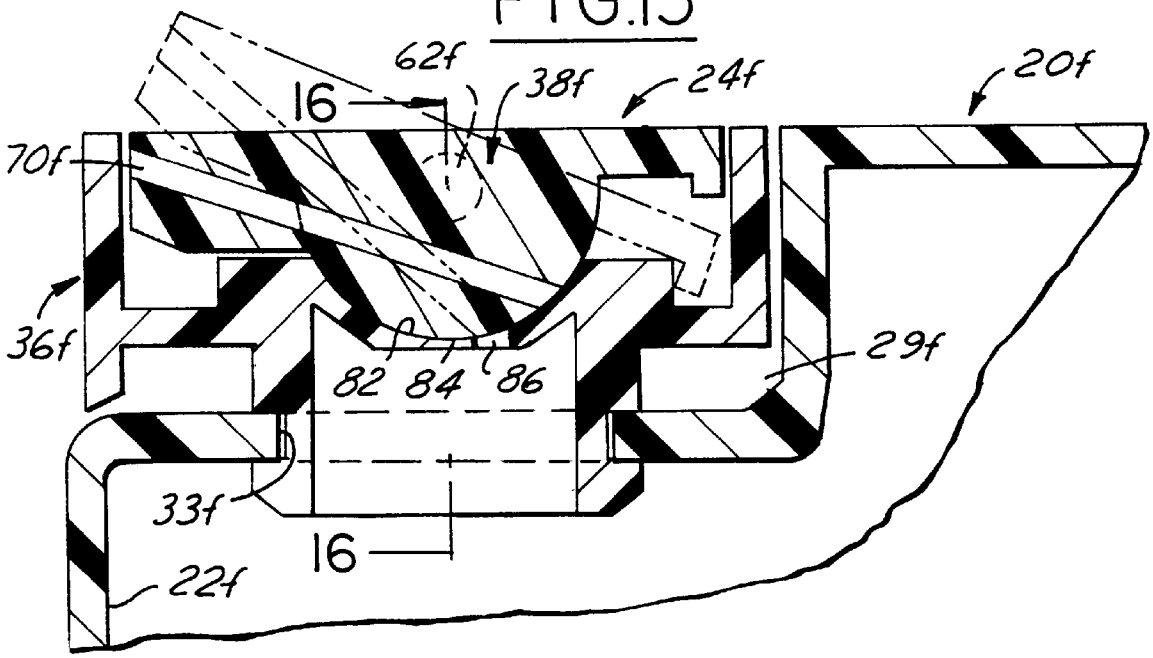
FIG. 15 is a fragmentary vertical sectional view of a further modified form of package.
Figure 16:
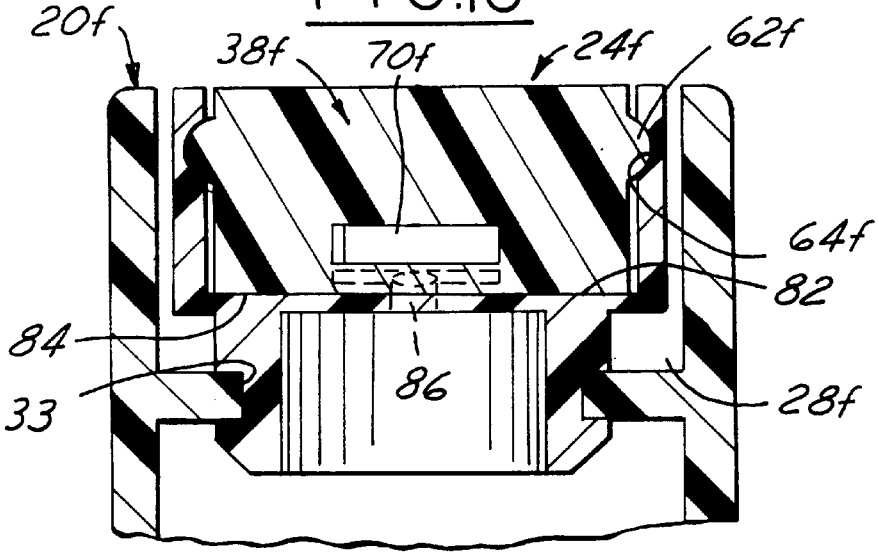
FIG. 16 is a fragmentary sectional view taken along the line 16—16 in FIG. 15.

In the modified form of dispensing package shown in FIGS. 15 and 16, the valve assembly 24*f* comprises a fitment 36*f* which snaps in position through the opening 33 in a manner like that shown in FIG. 14. The fitment 36*f* includes a concave surface 82 which is engaged by a convex portion 84 on the valve member 38*f* to bring a dispensing passage 70*f* into and out of position with an opening 86 in the fitment 36*f* by a toggle action. The valve member 38*f* is pivoted to the fitment 36*f* by engagement of bosses 62*f* with openings 64*f* in the fitment. The valve member 38*f* may be pushed inwardly to open as shown in FIG. 15 or may be provided with a projection at the other end to lift the valve member 38*f* to open position as shown in U.S. Pat. No. 4,399,928, incorporated herein by reference.

It can thus been seen that there have been provided dispensing packages which require less plastic material; permit portions thereof made in molds having d larger number of cavities; which have all portions easier to mold; and which provide proper control of the viscous product being dispensed; and which reduce the space needed for providing the necessary volume of package.

I claim:

1. A dispenser package for a fluent product comprising (a) an integrally molded plastic container having a flexible body portion with an upper exterior portion, an integral recessed portion inwardly recessed with respect to said upper exterior portion, said recessed portion having a base wall and at least one side wall extending upwardly from said base wall and having an outlet in said base wall of said recessed portion, and (b) a valve assembly mounted on said recessed portion, said valve assembly having an opening communicating with said outlet of the container, said valve assembly having a valve portion movable from a closed to an open position for providing access to the exterior such that the fluent product may be dispensed.

2. The dispenser package set forth in claim 1 wherein the valve assembly comprises a fitment having an opening communicating with the outlet of the container and a valve member associated with the opening in said fitment and movable into and out of closed position and open position on said container.

3. The dispenser package set forth in claim 2 wherein said container has a finish comprising an annular wall surrounding said outlet in said base wall of said container and said fitment and said annular wall having interengaging means thereon.

4. The dispenser package set forth in claim 3 wherein said annular wall of said finish extends axially outwardly with respect to said base wall of said container.

5. The dispenser package set forth in claim 4 wherein said interengaging means comprises annular bead means on said annular wall and said fitment.

6. The dispenser package set forth in claim 3 wherein said annular wall of said finish extends axially inwardly with respect to said base wall of said container.

7. The dispenser package set forth in claim 6 wherein said interengaging means comprises a plurality of projections on said fitment which extend through the opening in said finish and engage the free end of said annular wall.

8. The dispenser package set forth in claim 2 wherein said valve assembly comprises a toggle valve member pivoted on said fitment and having an opening therein which communicates with the outlet of the fitment in one position of the toggle valve member and a dispensing passage to the exterior which communicate with said opening in said toggle valve member to permit the dispensing of product and which closes communication with the outlet in another position of said toggle valve member.

9. The dispenser package set forth in claim 8 wherein said in said base wall of said recessed portion in said container is larger than the opening in said fitment.

10. The dispenser package set forth in claim 1 wherein said recessed portion has two opposed side walls, and wherein said valve assembly comprises a toggle valve member pivoted to the side walls of said recessed portion and having a dispensing passage adapted to communicate with said outlet on said container such that in one position the outlet is closed to communication with said outlet on said container an in another position the dispensing package is in communication with the outlet of the container.

11. The dispenser package set forth in claim 10 wherein said outlet in said base wall of said container comprises a finish defining said outlet extending outwardly from said base wall toward said valve member.

12. The dispenser package set forth in claim 1 wherein said valve assembly comprises a fitment which has an opening communicating with said outlet in the base wall of the recessed portion in said container, interengaging means between said fitment and said outlet of the container, said valve assembly including a manually operated valve member connected to said fitment by an integral hinge, said valve member being movable into and out of sealing relationship with the opening in the fitment.

13. The dispenser package set forth in claim 1 wherein said valve assembly comprises a fitment which has an opening communicating with said outlet in the base wall of the recess in said container, resilient diaphragm means associated with said opening in said fitment, interengaging means between said fitment and said outlet of the container, said valve assembly including a manually operated valve member connected to said fitment by an integral hinge, said valve member being movable into and out of overlying relationship with the opening in the fitment.

14. The dispenser package set forth in claim 1 wherein said valve assembly comprises a fitment, interengaging means between said fitment and said outlet of said container, a valve member pivotally mounted on said fitment, said fitment and said valve member having interengaging arcuate surfaces, an opening in said arcuate surface of said fitment communicating with said outlet in the base wall of said container, said valve member having a dispensing passage extending to the exterior of said valve member such that said valve member can be rotated to bring the dispensing passage into and out of communication with said opening in said fitment.

15. The dispenser package set forth in claim 1 wherein said recess extends generally across the entire width of the upper portion.

16. The dispenser package set forth in claim 15 wherein said upper portion of said container has a generally oval cross section and said recessed portion extends across the short axis of the cross section.

17. The dispenser package set forth in claim 1 wherein said upper portion of said container has a generally oval cross section having a long axis and short axis and said recessed portion extends from the periphery of said cross section along a portion of the long axis of the cross section.

18. The dispenser package set forth in claim 1 wherein said upper portion of the container has an elongated cross section with a long axis and a short axis, said upper portion having at least one inwardly directed recess formed adjacent said first mentioned recessed portion to minimize accumulation of product.

19. The dispenser package set forth in claim 1 wherein said upper portion of said container is transversely elongated and said recessed portion of said container is in the upper portion of the container adjacent the body portion thereby defining an open ended recess with said body portion.

20. The dispenser package set forth in claim 1 wherein said valve assembly has an external surface which conforms to the contour of the adjacent surfaces of the exterior portion when the valve assembly is in the closed position.

21. The method of making a dispensing package for fluent product comprising the steps of:

(a) forming an integrally molded plastic container having a flexible body portion and an upper exterior portion, an integral recessed portion inwardly recessed with respect to said upper exterior portion with said recessed portion having a base wall and at least one side wall extending upwardly from said base wall and having an outlet in said base wall of said recessed portion, (b) forming a valve assembly with a valve portion movable from a closed to an open position, and (c) mounting said valve assembly on said recessed portion over said outlet to provide access to the exterior such that the product may be dispensed.

22. The method set forth in claim 21 wherein said step of forming a valve assembly comprises forming a fitment having an opening communicating with the outlet of the container and forming a valve member associated with the opening in said fitment and movable into and out of closed position and open position on said container.

23. The method set forth in claim 22 wherein said step of forming said container comprises forming said finish with an annular wall surrounding said outlet in said base wall of said container and said step of forming said fitment comprises forming interengaging means on said annular wall.

24. The method set forth in claim 23 wherein said step of forming said annular wall of said finish is such that said annular wall extends axially outwardly with respect to said base wall of said container.

25. The method package set forth in claim 24 wherein said step of forming and interengaging means comprises forming annular bead means on said annular wall and forming annular bead means on said fitment.

26. The method set forth in claim 23 wherein said step of forming said annular wall of said finish is such that said annular wall extends axially inwardly with respect to said base wall of said container.

27. The method set forth in claim 26 wherein said step of forming said interengaging means comprises forming a plurality of projections on said fitment which extend through the opening in said finish and engage the free end of said annular wall.

28. The method set forth in claim 22 wherein said step of forming said valve assembly comprises forming a toggle valve member pivoted on said fitment and having an opening therein which communicates with the outlet of the fitment in one position of the toggle valve and a dispensing passage to the exterior which communicate with said opening in said toggle valve to permit the dispensing of the liquid product and which closes communication with the outlet in another position of said toggle valve.

29. The method set forth in claim 28 wherein said step of forming said container comprises said opening in said base wall of said recess in said container such that it is larger than the opening in said fitment.

30. The method set forth in claim 21 wherein said step of forming said integrally molded plastic container includes forming opposed side walls in the recessed portion of the container, and wherein said step of forming said valve assembly comprises forming a toggle valve member pivoted to the side walls of said recess and having a dispensing passage adapted to communicate with said outlet on said container such that in one position the outlet is closed to communication with said outlet on said container and in another position the dispensing package is in communication with the outlet of the container.

31. The method set forth in claim 30 wherein said step of forming said outlet in said base wall of said container comprises forming a finish defining said outlet extending outwardly from said base wall toward said valve member.

32. The method set forth in claim 21 wherein said step of forming said valve assembly comprises forming a fitment which has an opening communicating with said outlet in the base wall of the recess in said container, forming interengaging means between said fitment and said outlet of the container, forming said valve assembly with a manually operated valve member connected to said fitment by an integral hinge such that said valve member is movable into and out of sealing relationship with the opening in the fitment.

33. The method set forth in claim 21 wherein said step of forming said valve assembly comprises forming a fitment which has an opening communicating with said outlet in the base wall of the recess in said container, forming a resilient diaphragm means associated with said opening in said fitment, forming interengaging means between said fitment and said outlet of the container, forming said valve assembly with a manually operated valve member connected to said fitment by an integral hinge such that said valve member is movable into and out of overlying relationship with the opening in the fitment.

34. The method set forth in claim 21 wherein said step of forming said valve assembly comprises forming a fitment, forming interengaging means between said fitment and said outlet of said container, forming a valve member pivotally mounted on said fitment, forming said fitment and said valve member with interengaging arcuate surfaces, forming an opening in said arcuate surface of said fitment communicating with said outlet in the base wall of said communicating with said outlet in the base wall of said container, forming said valve member with a dispensing passage extending to the exterior of said valve member such that said valve member can be rotated to bring the dispensing passage into and out of communication with said opening in said fitment.

35. The method set forth in claim 21 wherein said recess extends generally across the entire width of the upper portion.

36. The method set forth in claim 35 wherein said upper portion of said container has a generally oval cross section and said recess extends across the short axis of the cross section.

37. The method set forth in claim 21 wherein said step of forming said upper portion of the container is such that it has an elongated cross section with a long axis and a short axis, said upper portion having at least one inwardly directed recess formed adjacent said first mentioned recess to minimize accumulation of product.

38. The method set forth in claim 21 wherein said step of forming said upper portion of said container is such that it is transversely elongated and said recessed portion of said container is in the upper portion of the container adjacent the body portion thereby defining an open ended recess with said body portion.

* * * * *